United States Patent [19]

Shen

[11] Patent Number: 4,809,526

[45] Date of Patent: Mar. 7, 1989

[54] CARTRIDGE OF A PANIC PROOF LOCK

[76] Inventor: Chao C. Shen, No. 233, Hai Tien Rd., Sec. 2, Tainan, Taiwan

[21] Appl. No.: 221,656

[22] Filed: Jul. 20, 1988

[51] Int. Cl.[4] ..... E05B 59/00

[52] U.S. Cl. ..... 70/107; 70/462; 272/21; 272/39

[58] Field of Search ..... 70/107, 462, 110; 292/39, 336.3, 21, 34

[56] References Cited

U.S. PATENT DOCUMENTS

| | | | |
|---|---|---|---|
| 1,664,984 | 4/1928 | Lanphere | 70/107 |
| 3,791,180 | 2/1974 | Doyle | 70/107 |
| 3,910,613 | 10/1975 | Nolin | 70/462 |
| 3,999,789 | 12/1976 | Maurits et al. | 70/107 |
| 4,129,019 | 12/1978 | Urdal | 70/462 |
| 4,322,958 | 4/1982 | Eigemeier | 70/107 |
| 4,333,324 | 6/1982 | Dietrich et al. | 70/107 |
| 4,418,552 | 12/1983 | Nolin | 70/107 |
| 4,606,203 | 8/1986 | Esser | 70/462 |
| 4,616,864 | 10/1986 | Douglas | 292/39 |

FOREIGN PATENT DOCUMENTS

| | | | |
|---|---|---|---|
| 2486135 | 1/1982 | France | 70/107 |

*Primary Examiner*—Gary L. Smith

*Assistant Examiner*—Eric K. Nicholson

*Attorney, Agent, or Firm*—Morton J. Rosenberg

[57] ABSTRACT

A cartridge of a panic proof lock comprising a pair of cartridge plates, a pair of slides, a pair of half-serrated rings, a collar and a rotary lever. The cartridge plates have two holes to accommodate two spindles of the lock and a flange perpendicular thereto to guide the movement of the slides. The slides which are inverted U-shaped with one limb inside toothed are oppositely disposed. The half-serrated rings with serration in opposite half circles are disposed inside the slides with the serrations engaging with the corresponding toothed limb of the corresponding slide. Inside each of the half-serrated ring, a pair of recesses are formed to receive the teeth of a collar disposed inside the half-serrated rings. Each recess of the half-serrated ring is larger than the corresponding tooth on the collar so that there is a 40 degree (20 degree for each direction) dead zone of rotation between the collar and the half-serrated rings. The collar has an inside projection which is engageable with one of the spindles to transmit torque to the half-serrated rings and thus to move the slides upwards and downwards. Outside the bottom of each of the slides, a semi-circular notch together with a pair of identical projection disposed thereby is formed.

2 Claims, 4 Drawing Sheets

CARTRIDGE OF A PANIC PROOF LOCK

BACKGROUND OF THE PRESENT INVENTION

The present invention relates to door locks and in particular to the cartridge mechanism of a panic proof lock.

U.S. Pat. No. 4,129,019 issued to Urdal entitled "Cartridge For A Lockset" has disclosed a simple cartridge construction joining two individual, standard devices which are collectively referred to as a lockset. The cartridge which interengages with the spindles of the individual locks contains a mechanism for actuating both of the standard locks from one of the lock operators and is thin enough to be applied to installations already in existence and to new installations. The usual environment for the lockset cartridge is in connection with a door panel mounted on hinges in a door frame in a surrounding wall. The frame is provided with one or more strike boxes arranged to receive two bolts, a latch bolt and a dead bolt. In many installations, the latch bolt is provided with a keyed operator on the exterior and a knob or a lever on the interior. The dead bolt is provided with a key actuator on the exterior and a thumb turn on the interior. The latch bolt mechanism governed by the controllers is a standard, independent lockset readily available and of a kind already installed on many door panels. Comparably, the mechanism of the dead bolt structure controlled by the key and the operator is itself a separate, standard mechanism as already installed in many door panels.

Urdal's lock, however, has a drawback. The movement of the moving parts in Urdal's cartridge mechanism is restricted by mounting screws so that the latch bolt has to be shortened. It is, therefore, the object of the present invention to provide a cartridge mechanism such that the latch bolt need not be cut down to a shorter length.

SUMMARY OF THE INVENTION

It is the primary object of the present invention to provide a cartridge mechanism for a panic proof lock wherein the rotation of the spindle of the latch bolt is not restricted by mounting screws so that it is not necessary to remove part of the latch bolt.

Other objects and advantages of this invention will be observed by those having ordinary skill in the art when the following detailed description has been read in conjunction with the accompanying drawings, wherein:

BRIEF DESCRIPTION OF THE DRAWINGS

FIG. 3-1 and 3-2 are views drawn to larger scale, showing the sequential motion of the slides to rotate the rotary lever so as to retract the dead bolt;

DETAILED DESCRIPTION OF THE PREFERRED EMBODIMENTS

Figure 1:
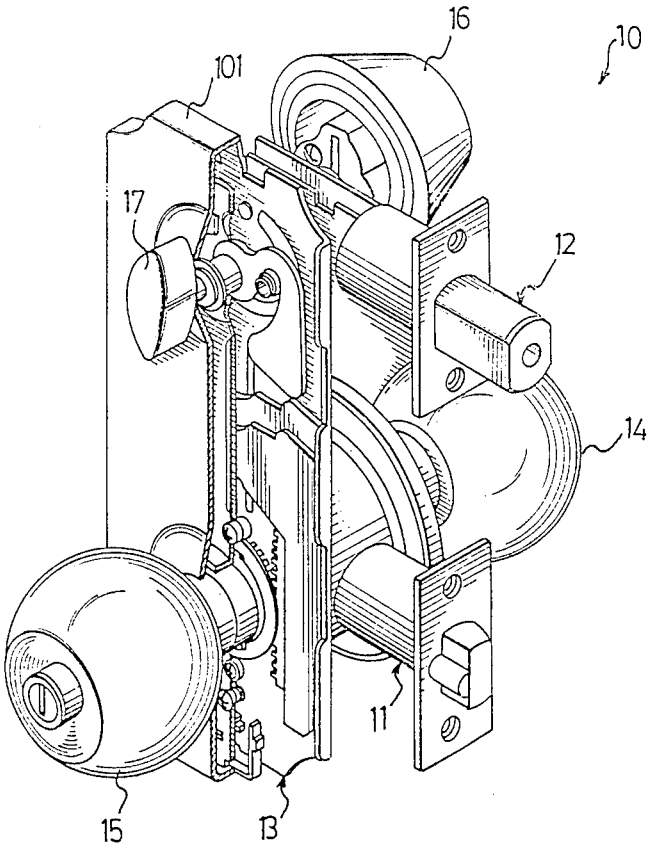
FIG. 1 is a perspective view of a panic proof lock with a cartridge in accordance with the present invention installed therein, a portion thereof being broken away for clarity.

For purpose of promoting an understanding of the principles of the invention, reference will be made to the embodiments illustrated in the drawings. It will, nevertheless, be understood that no limitation of the scope of the invention is thereby intended, such alternatives and further modifications in the illustrated device and such further applications of the principles of the invention as illustrated herein being contemplated as would normally occur to one skilled in the art to which the invention relates.

With reference to FIG. 1, a panic proof lock 10 comprises a latch bolt mechanism 11, a dead bolt mechanism 12 and a cartridge mechanism 13. The latch bolt mechanism 11 is coupled with a keyed exterior knob 14 and an interior knob 15. The dead bolt mechanism 12 is coupled with a keyed rosette 16 on the exterior and a thumb turn 17 on the interior. The cartridge 13 is disposed behind the interior escutcheon 101.

Figure 2:
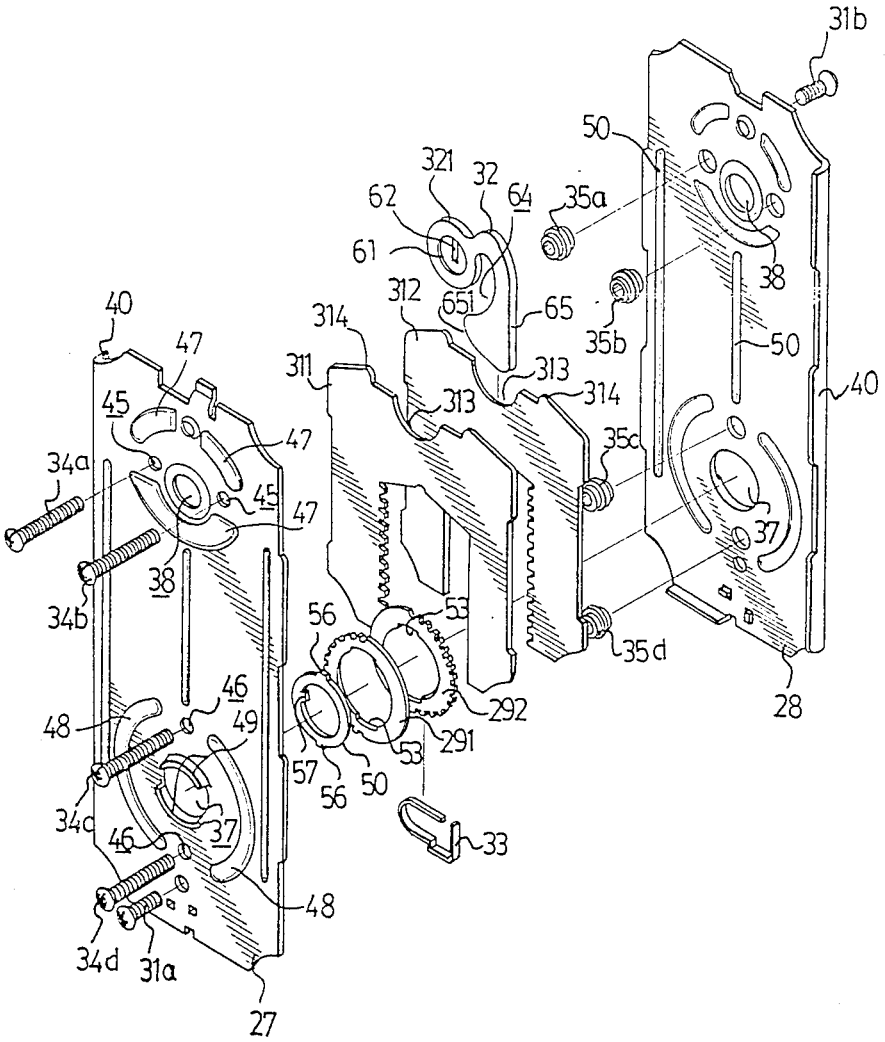
FIG. 2 is an exploded view of a cartridge constructed in accordance with the present invention.

Referring to FIG. 2, the cartridge 13 consists of a pair of cartridge plates 27 (the first cartridge plate) and 28 (the second cartridge plate), a pair of slides 311 (the first slide) and 312 (the second slide), a collar 30, a rotary lever 32, a spring-loaded catch 33, two assembly screws 31*a*, and 31*b*, four mounting screws 34*a*, 34*b*, 34*c* and 34*d*, and four screw supporting shells 35*a*, 35*b*, 35*c* and 35*d*.

The cartridge plates 27 and 28 are identical in configuration. The cartridge plate 27, being exemplary, is generally a rectangular plate substantially symmetric with respect to the longitudinal central line. Two openings 37 and 38 are formed in the cartridge plate 27. One of the opening, which is indicated by reference number 38, is large enough to accommodate the spindle of the dead bolt and the other one, which is indicated by reference numeral 37, is large enough to accommodate the spindle of the latch bolt. Both spindles are not clearly shown on the drawings. The openings 37 and 38 are properly disposed along the longitudinal central line of the cartridge plates 27 and 28 to conform to the standard mounting of the two lock mechanisms 11 and 12.

Disposed on one of the longitudinal edges of the cartridge plate 27 is a right-angledly-turned flange 40, which is more clearly shown on the second cartridge plate 28, to provide an intervening space between the cartridge plate and to guide the up-and-down movement of the slides 311 and 312 when the cartridge plates are superposed with the flange 40 of one abutting the surface of the other.

Each of the cartridge plates 27 and 28 has two pairs of apertures 45 and 46 to receive the mounting screws 34. Apertures 45 are horizontally provided at both sides of the opening 38, while apertures 46 are provided at the upper and lower sides of the opening 37 in vertical alignment.

Arcuate circumferential folds 47 are formed in proximaty to and around the opening 38 and a pair of arcuate circumferential folds 48 in proximity to and around the opening 37 for purpose of strengthening the structure thereof. In addition, a pair of partial circumferential rims 49 around the opening 37 are formed to reinforce the structure thereof. Each of the cartridge plates 27 and 28 is provided with three longitudinal, shallow grooves 50 to further reinforce the structure thereof.

The slides 311 and 312 which are identical in configuration are inverted U-shaped plates. One of the limbs of each slide 311 and 312 is toothed inside. The first slide 311 is toothed in the first limb and the second slide 312 in the second limb. Outside the bottom of the slides 311 and 312, a semi-circular notch 313 is formed in the center. Two identical projections 314 are symmetrically formed on both sides of the notch 313.

A pair of half-serrated rings 291 and 292 with substantially the same thickness as the slides 311 and 312 are disposed inside the slides 311 and 312 with the serration engaging with the corresponding toothed limbs. Inside the half-serrated rings 291 and 292, two recesses 53 are formed to cooperate with the collar 30.

The collar 30 of which the outside diameter is substantially the same as the inside diameter of the half-serrated rings 291 and 292 comprises two outwardly projecting teeth 56 corresponding to the recesses 53 of the half-serrated rings 291 and 292. The inside diameter of the collar 30 is large enough to accommodate the spindle of the latch bolt. The collar 30 also has an inwardly projecting tooth 57 to engege with the spindle of the latch bolt and transmit torque from the spindle to the half-serrated rings 291 and 292. The thickness of the collar 30 is substantially the same as the total thickness of the half-serrated rings 291 and 292 so that the rotation of the collar 30 can rotate both half-serrated rings.

The rotary lever 32 is generally a disc 321 with an arc tail 65. Formed in the disc 321 is a central circular recess 61 with a rectangular slot 62 pierced thereon to engage with the spindle of the dead bolt so that rotating the rotary lever 32 will rotate the spindle of the dead bolt. The configuration of the rotary lever 32 forms an arcuate cutout 64 which define the passage for one of the screws 34 and screw supporting shells 35. The tail 65 has an inclined face 651 which matches one of the upward projection 314 of the slides 311 and 312. The inclined face 651 and the projection 314 act as a cam-follower couple. The thickness of the rotary lever 32 substantially amounts to the total thickness of the slides 311 and 312 so that, due to the inclined face 651, the upward movement of either slide 311 or 312 pushes the tail 651 upwards and thus rotates the rotary lever 32.

The spring-loaded catch 33 is a resilient metal wire emplaced below the half-serrated rings 291 and 292.

A first screw indicated by reference numeral **34*a* passes through one of the apertures 45 of the second cartridge plate 28, a first screw supporting shell 35*a*, the corresponding aperture 45 on the first cartridge plate 27, and finally engages with the dead bolt mechanism 12**.

A second screw indicated by reference numeral **34*b* passes through another aperture 45 of the second cartridge plate 28, the arcuate cutout portion 64, a second screw supporting shell 35*b*, the corresponding aperture 45 on the first cartridge plate 27, and finally engages with the dead bolt mechanism 12**.

A third screw indicated by reference numeral **34*c* passes through one of the apertures 46 of the second cartridge plate 28, a third screw supporting shell 35*c*, and the corresponding aperture 46 on the first cartridge plate 27, and finally engages with the latch bolt mechanism 11**.

A fourth screw indicated by reference numeral **34*d* passes through another aperture 46 of the second cartridge plate 28, a fourth screw supporting shell 54*d*, and the corresponding aperture 46 on the first cartridge plate 27, and finally engages with the latch bolt mechanism 11**.

The four screw supporting shells **35*a*, 35*b*, 35*c* and 35*d* are provided so as to maintain the intervening space 39 when the screws 34*a*, 34*b*, 34*c* and 34*d*** are tightened.

Figures 1, 3:
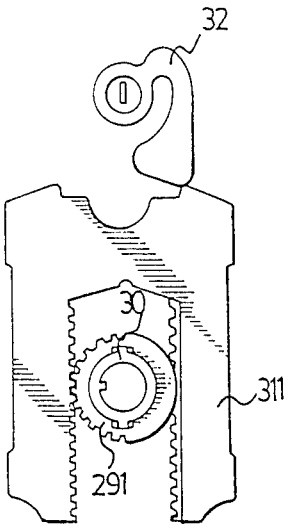
Figures 2, 3:
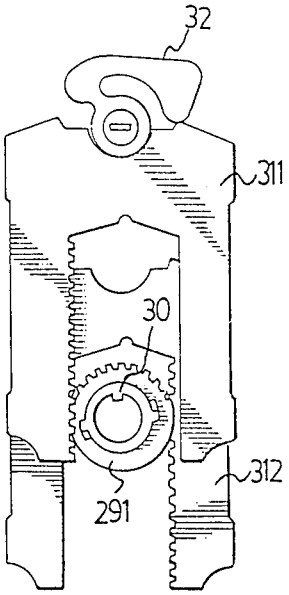

The interengaging action of the cartridge 13 is depicted in FIG. 3. When the interior knob 15 of the latch bolt is turned, the spindle of the latch bolt and thus the collar 30 is rotated. The rotation is transmitted to the half-serrated rings 291 and 292 with about 20 degrees angle lag by the outwards teeth 56 which is retained within the recesses 53 of the half-serrated rings. With the engagement of the half-serrated rings 291 and 292 with the toothed limbs of the slides 311 and 312, rotating the rings 291 and 292 moves one of the slides 311 and 312 upwards and the other downwards. The upwards-moving slides will rotate the rotary lever 32 as being explained hereinbefore so that the spindle of the dead bolt is retracted.

Figure 4:
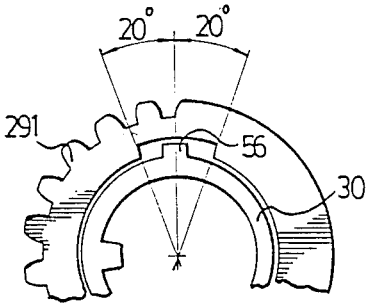
FIG. 4 is a view drawn to further larger scale to show the relationship between the half-serrated ring and the collar.

As shown in FIG. 4, the collar 30 is entrapped in the half-serrated rings 291 and 292 with the two outwardly projecting teeth 56 thereof retained within the recesses 53 of the half-serrated rings 291 and 292. The recesses 53 are slightly larger than the teeth 56 so as to permit an extra 20 degrees of rotation of the collar 30 in either direction with respect to the rings 291 and 292. With this extra 20 degrees of rotation, the spindle of the latch bolt could be further rotated and thus the latch bolt could be further retracted to avoid cutting off the latch bolt.

Figure 5:
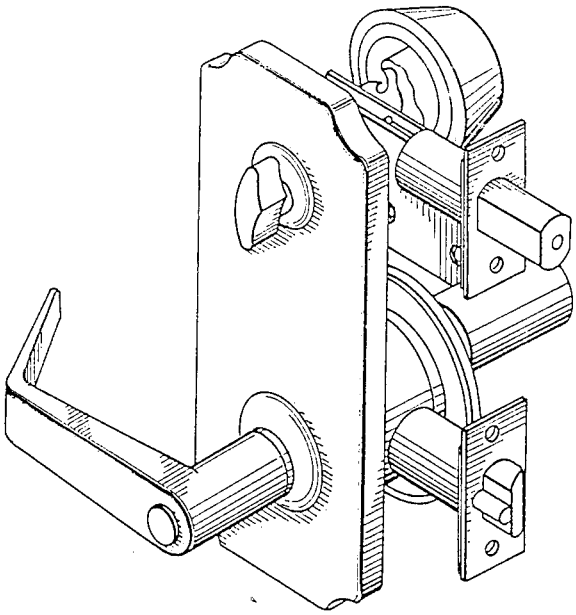
FIG. 5 is another embodiment in accordance with the present invention wherein the latch bolt is controlled by a lever.

FIG. 5 shows another embodiment in accordance with the present invention wherein the knob-type operator of the latch bolt mechanism is replaced by a lever type operator.

Although this invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A cartridge of a panic proof lock comprising a first cartridge plate which is generally rectangular, a second cartridge plate which is identical to said first cartridge plate, a first slide which is an inverted U-shaped plate with a limb inside-toothed, a second slide which is identical to said first slide, a collar which is a flat ring with two outside teeth and an inside projection, a first half-serrated ring with two inside recesses a second half-serrated ring which is identical to said first half-serrated ring, a spring-loaded catch which is a resilient metal wire, a rotary lever which is a disc with an arc tail, two assembly screws, four mounting screws and four screw supporting shells;

said first cartridge plate having two holes formed thereon to accommodate two spindles of the panic proof lock, said cartridge plate further having a flange perpendicular thereto to provide an intervening space between said first and second cartridge plates when said cartridges are superposed on each other and to guide the up-and-down movement of said slides, on one of the longitudinal edges, said first cartridge plate having four screw apertures through which said mounting screws with said supporting shells encompassing thereon are received and two assembly screw apertures through which said assembly screws are received to screw said cartridge plates together, two of said four screw apertures being horizontally disposed by a first hole of said two holes through which a first spindle of said two spindles is insertable and the other two screw apertures being vertically disposed by the other hole of said two holes through which the second spindle of said two spindles is insertable;

said collar with the thickness amounting to the total thickness of said first and second half-serrated rings and the outside diameter of said collar substantially the same as the inside diameter of said half-serrated rings and being disposed in said half-serrated rings with the teeth disposed in the corresponding recesses of said half-serrated rings, the inside projection of said collar being engageable with said second spindle to transmit torque to said half-serrated rings;

said first and second half-serrated rings with serration in opposite half circle being disposed within said slides with the serrations engaging with the toothed limbs of said slides, the toothed limbs of said first slide being positioned in different sides of the central longitudinal line from that of said second slide so as to match the serration in the opposite half circle;

said slides being so engaged with the half-serrated rings that when said rings rotate, said first slide is moved upwards and the second downwards, each of said slides having a semi-circular notch formed outside the bottom of said slide and a pair of identical projections symmetrically disposed by said semi-circular notch, said semi-circular notch having substantially the same dimension as the disc of said rotary lever, each of said slides having substantially the same thickness of each of said half-serrated rings;

said rotary lever with thickness amounting to the total thickness of said slides being so disposed that an inclined face of the tail thereof is contactable with one of the projections of said slides in a cam-follower style and that when one of said slides moves upwards, said tail is pushed upwards and thus said rotary lever is rotated, said rotary lever further having a central circular recess on the disc thereof and a rectangular slot formed in said recess with which said first spindle is engageable so that when said rotary lever is rotated, said first spindle is rotated too; and said spring-loaded catch being emplaced under said half-serrated rings.

2. A cartridge of a panic proof lock as set forth in claim 1 wherein each of the recesses inside said half-serrated rings is larger than the corresponding outside tooth of said collar so that there is about a 20 degree lag of the rotation of said half-serrated rings behind that of said collar in both directions.

* * * * *